US010200782B2

(12) United States Patent
Huang et al.

(10) Patent No.: US 10,200,782 B2
(45) Date of Patent: Feb. 5, 2019

(54) SPEAKER STRUCTURE

(71) Applicant: ASUSTek COMPUTER INC., Taipei (TW)

(72) Inventors: Lai-Shi Huang, Taipei (TW); Yen-Hsin Ho, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 434 days.

(21) Appl. No.: 14/924,710

(22) Filed: Oct. 27, 2015

(65) Prior Publication Data

US 2016/0127823 A1 May 5, 2016

Related U.S. Application Data

(60) Provisional application No. 62/069,849, filed on Oct. 29, 2014.

(30) Foreign Application Priority Data

Jul. 20, 2015 (TW) ..... 104123394 A

(51) Int. Cl.
*H04R 1/28* (2006.01)
*H04R 1/02* (2006.01)
*H04R 9/06* (2006.01)

(52) U.S. Cl.
CPC ..... *H04R 1/2811* (2013.01); *H04R 1/025* (2013.01); *H04R 1/2819* (2013.01);
(Continued)

(58) Field of Classification Search
CPC .... H04R 1/2834; H04R 1/2896; H04R 1/026; H04R 1/02; H04R 1/025; H04R 1/283;
(Continued)

(56) References Cited

U.S. PATENT DOCUMENTS 2,846,520 A * 8/1958 Brownscombe ..... H04R 1/42 181/148
3,524,027 A * 8/1970 Schamp ..... H04R 1/021 381/152

(Continued)

FOREIGN PATENT DOCUMENTS

CN 201674644 12/2010
CN 201821486 5/2011

(Continued)

OTHER PUBLICATIONS

"Office Action of Taiwan Counterpart Application", dated Jul. 12, 2016, p. 1-p. 4.

*Primary Examiner* — Oyesola C Ojo
(74) *Attorney, Agent, or Firm* — JCIPRNET

(57) ABSTRACT

A speaker structure includes a speaker box, a speaker unit, and an elastic component. An air pressure inside the speaker box is lower than that outside the speaker box. The speaker unit is disposed on the speaker box and includes a first vibrating assembly. The elastic component is disposed in the speaker box and connected to the first vibrating assembly and the speaker box in the speaker unit. When the speaker unit operates, the first vibrating assembly of the speaker unit vibrates, and the elastic component produces a pre-force correspondingly, the total pressure of the pre-force and the air pressure inside the speaker box equals to the air pressure outside the speaker box to balance the first vibrating assembly at an equilibrium position.

9 Claims, 2 Drawing Sheets

(52) U.S. Cl.
CPC ..... *H04R 1/2834* (2013.01); *H04R 9/066* (2013.01); *H04R 2201/025* (2013.01); *H04R 2499/11* (2013.01)

(58) Field of Classification Search
CPC .. H04R 1/2807; H04R 1/2811; H04R 1/2823; H04R 1/2826; H04R 1/2892; H04R 1/42; H04R 9/066; H04R 1/25; H04R 1/345; H04R 7/20; H04R 9/02; H04R 9/06; H04R 1/34; H04R 7/02; H04R 9/045; H04R 9/046; H04R 31/006; H04R 2499/11
USPC ..... 381/345, 162, 165, 335, 332, 56, 57, 58, 381/62, 63, 64, 65
See application file for complete search history.

(56) References Cited

U.S. PATENT DOCUMENTS 6,519,346 B1 2/2003 Asada et al.
7,006,651 B2 * 2/2006 Ueki ..... H04R 1/44 381/396
8,761,417 B2 * 6/2014 Oser ..... H04R 5/023 381/152
2005/0276434 A1 * 12/2005 Kobayashi ..... H04R 9/06 381/396
2010/0316235 A1 * 12/2010 Park ..... H04R 1/025 381/151
2011/0026751 A1 * 2/2011 Hilbowicki ..... H04R 1/2807 381/345
2013/0195311 A1 * 8/2013 Sahyoun ..... H04R 1/2834 381/395
2015/0016652 A1 * 1/2015 Moro ..... H04R 1/2811 381/353
2015/0245122 A1 * 8/2015 Rayner ..... H04R 1/2834 381/152

FOREIGN PATENT DOCUMENTS

EP 0330423 8/1989
TW M327611 2/2008

* cited by examiner

SPEAKER STRUCTURE

CROSS-REFERENCE TO RELATED APPLICATION

This application claims the priority benefits of U.S. provisional application Ser. No. 62/069,849, filed on Oct. 29, 2014 and TW application serial No. 104123394, filed on Jul. 20, 2015. The entirety of each of the above-mentioned patent applications is hereby incorporated by reference herein and made a part of specification.

BACKGROUND OF THE INVENTION

Field of the Invention

The invention relates to a speaker structure.

Description of the Related Art

Recent years, electronic devices such as notebooks, tablet computers and smartphones become smaller and thinner. As a result, a speaker structure therein becomes thinner accordingly.

A speaker structure usually includes a speaker unit and a speaker box. The elastic coefficient of the speaker structure affects acoustical quality, and the elastic coefficient of the speaker structure depends on the elastic coefficient of a suspension structure of the speaker unit and the elastic coefficient of the air in the speaker box. Under a condition of a same speaker unit, the volume of the speaker box and the elastic coefficient of air in the speaker box affect the acoustical quality of the speaker structure.

To improve the low-frequency response with the resonant frequency of the speaker structure and get good acoustical quality of the speaker structure, the volume of the speaker box is improved and the elastic coefficient of the air in the speaker box is decreased. It is known that when the volume of the speaker structure is decreased, the elastic coefficient of the air in the speaker box is increased, the low-frequency response with the resonant frequency of the speaker structure becomes poor, and thus acoustical quality becomes poor. Consequently, good acoustical quality is not easily reached while electronic device becomes smaller and thinner.

BRIEF SUMMARY OF THE INVENTION

A speaker structure is provided in a small volume with increased acoustical quality.

A speaker structure includes a speaker box, a speaker unit, and an elastic component. An air pressure inside the speaker box is lower than the air pressure outside the speaker box. The speaker unit is disposed on the speaker box and includes a first vibrating assembly. The elastic component is disposed in the speaker box and connected to the first vibrating assembly and the speaker box in the speaker unit. When the speaker unit operates, the first vibrating assembly of the speaker unit vibrates, the elastic component produces a pre-force correspondingly, the pre-force and the air pressure inside the speaker box equal to the air pressure outside the speaker box to maintain the first vibrating assembly at an equilibrium position.

The elastic component in the speaker box is connected to the first vibrating assembly and the speaker box of the speaker unit, and the air pressure inside the speaker box is lower than the air pressure outside the speaker box. When the speaker unit operates, the first vibrating assembly vibrates to push the air in the speaker box and drive the elastic component to generate a pre-force correspondingly, and the pre-force of the elastic component and the air pressure inside the speaker box equal to the air pressure outside the speaker box, and then the first vibrating assembly maintains at the equilibrium position. Since the air pressure inside the speaker box is reduced, the volume of the speaker box is reduced. The speaker unit vibrates the elastic component, which compensates for the pre-force of the reduced air in the speaker box to balance the vibration of the first vibrating assembly. Consequently, the acoustical quality is kept while the volume of the speaker structure is decreased.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
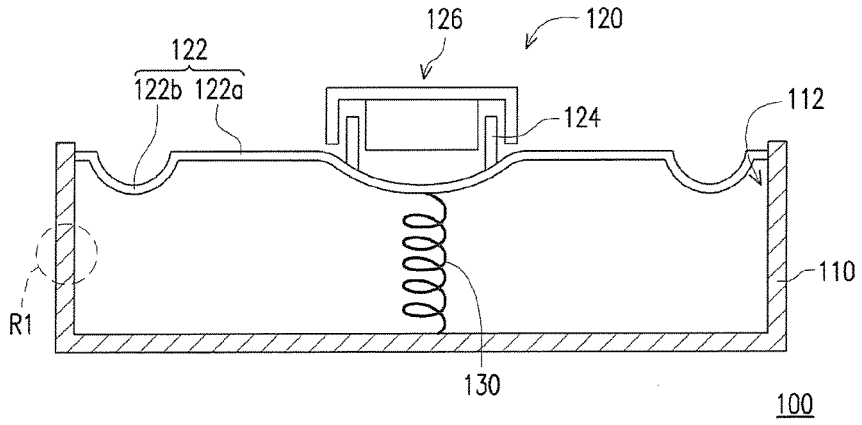
FIG. 1 is a schematic diagram showing a speaker structure in an embodiment.

FIG. 1 is a schematic diagram showing a speaker structure in an embodiment. In the embodiment, a speaker structure 100 includes a speaker box 110, a speaker unit 120 and an elastic component 130.

The speaker unit 120 is disposed on the speaker box 110, and the speaker unit 120 includes a first vibrating assembly 122. The elastic component 130 is disposed in the speaker box 110, and the elastic component 130 is connected to the first vibrating assembly 122 of the speaker unit 120 and the speaker box 110. The air pressure inside the speaker box 110 is lower than that outside the speaker box 110. When the speaker unit 120 operates, the first vibrating assembly 122 of the speaker unit 120 vibrates the air (in an embodiment, the "air" herein does not limit the kind of gas, which is adjustable according to requirements) inside the speaker box 110, and the elastic component 130 produces a corresponding pre-force.

In the embodiment, the speaker box 110 is a box includes an opening 112. The speaker unit 120 is disposed on the speaker box 110 and covers part of the speaker box 110. In an embodiment, the first vibrating assembly 122 covers the opening 112, and seals the speaker box 110.

In an embodiment, except for the first vibrating assembly 122, the speaker unit 120 also includes a voice coil 124, a magnetic loop assembly 126. In an embodiment, the magnetic loop assembly 126 is a combination of a magnet unit and a magnetic conducting unit. The ring shaped voice coil 124 (FIG. 1 shows a section view of the ring-shaped voice coil 124 which is at two sides of the magnetic loop assembly 126 shown in the section view) is disposed in the magnetic loop assembly 126, and the voice coil 124 is further connected to the first vibrating assembly 122, which is not limited herein.

In an embodiment, the first vibrating assembly 122 and the voice coil 124 form a vibration system of the speaker unit 120, and the area for the vibration system is a vibration surface of the speaker structure 100. When the speaker unit 120 operates, the magnetic loop assembly 126 drives the voice coil 124 to vibrate, and the voice coil 124 drives the first vibrating assembly 122 to vibrate. It is to be understood that the components of the speaker unit 120 are varies and adjustable according to requirements and is not limited herein.

In the embodiment, the first vibrating assembly 122 includes a first vibrating diaphragm 122*a* and a first suspension side edge 122*b*. The first vibrating diaphragm 122*a* is disposed at the speaker box 110 and connected to the elastic component 130. The first suspension side edge 122*b* is disposed on the speaker box 110 and connected to the first vibrating diaphragm 122*a*.

The first vibrating diaphragm 122*a* is connected to the voice coil 124, and the first suspension side edge 122*b* is connected to the first vibrating diaphragm 122*a* and surrounds the outer edge of the first vibrating diaphragm 122*a*. In an embodiment, the first vibrating diaphragm 122*a* is circle-shaped, and the first suspension side edge 122*b* is ring-shaped (the ring-shaped first suspension side edge 122*b* is at two sides of the first vibrating diaphragm 122*a* in the section view shown in FIG. 1), which is not limited herein.

In an embodiment, the first vibrating diaphragm 122*a* and the first suspension side edge 122*b* include concave surfaces, respectively. The concave surface is towards the speaker box 110, and the thickness of the speaker structure 100 would not be increased. However, the shapes of the first vibrating diaphragm 122*a* and the first suspension side edge 122*b* are adjustable and are not limited herein.

In an embodiment, the voice coil 124 vibrates the first vibrating diaphragm 122*a*. When the speaker unit 120 operates, the voice coil 124 in vibrating drives the first vibrating diaphragm 122*a* connected to the voice coil 124 to vibrate with the first suspension side edge 122*b* regarded as a suspension structure, and the air in the speaker box 110 is pressed.

In the embodiment, the elastic component 130 is in the speaker box 110 and connected to the first vibrating assembly 122 and the speaker box 110. One end of the elastic component 130 is connected to the first vibrating diaphragm 122*a* of the first vibrating assembly 122, and the other end of the elastic component 130 is connected to an inner surface of the speaker box 110. When the speaker unit 120 operates, the first vibrating diaphragm 122*a* of the first vibrating assembly 122 is driven by the voice coil 124 to vibrate, and then the elastic component 130 is pressed to produce the pre-force.

In an embodiment, the elastic component 130 is a coil spring, and the elastic coefficient is adjustable according to requirements (the elastic coefficient is adjustable by adjusting diameter, length, the number of turns and other parameters). In an embodiment, the elastic component 130 is a compression spring, which is not limited herein.

In an embodiment, to avoid the distortion when the elastic component 130 affects the magnetic loop assembly 126 of the speaker unit 120, the elastic component 130 includes a nonmagnetic material. The material of the elastic component 130 is selected according to requirements, which is not limited herein.

In the embodiment, the air pressure inside the speaker box 110 is lower than outside the speaker box 110. In an embodiment, the air pressure outside the speaker box 110 is about 1 atm and the air pressure inside the speaker box 110 is lower than 1 atm. In an embodiment, the air pressure inside the speaker box 110 is less than 80% of that outside the speaker box 110, which is 20% less than that outside the speaker box 110. In an embodiment, the speaker box 110 is vacuumed, that is, the air pressure inside the speaker box 110 is about 0 atm. However, the air pressure inside the speaker box 110 is adjustable according to requirements, which is not limited herein.

In embodiments, the air pressure inside the speaker box 110 is lower than the air pressure outside the speaker box 110, the air in the speaker box 110 is reduced, and thus the volume of the speaker box 110 is reduced. In other words, the air pressure in the speaker box 110 is reduced, and thus the required air volume is decreased. However, when the elastic coefficient of the speaker box 110 is too large, the first vibrating assembly 122 is not easily moved, thus, the elastic component 130 is applied.

In the embodiment, the elastic coefficient of the speaker box 110 is increased due to the decrease of the air volume in the speaker box 110, however, when the speaker unit 120 operates, the speaker unit 120 drives the elastic component 130 in the speaker box 110 to move. In other words, when the speaker unit 120 operates, the first vibrating assembly 122 vibrates while the air in the speaker box 110 and the elastic component 130 are pushed. The volume and the elastic coefficient of the elastic component 130 are lower than that of the air inside the speaker box 110. The volume and the elastic coefficient of the elastic component 130 are adjustable to compensate the increased elastic coefficient due to the decreased air volume inside the speaker box 110.

Since the air pressure inside the speaker box 110 is smaller than outside the speaker box 110, the elastic component 130 in the speaker box 110 is compressed. As a result, when the first vibrating assembly 122 vibrates, the first vibrating diaphragm 122*a* pushes the air in the speaker box 110 while the first vibrating diaphragm 122*a* pushes the elastic component 130 repeatedly (for example, compressing the elastic component 130) to produce the pre-force. The pre-force herein is the opposing force that the elastic component 130 applying to the first vibrating assembly 122, the pre-force (opposing force) which is generated when the elastic component 130 is pushed directly relates to the operations of the speaker unit 120 and the first vibrating assembly 122. The compressed elastic component 130 produce the pre-force to counter the first vibrating assembly 122 to balance the effect on the first vibrating assembly 122 due to the air pressure difference inside/outside the speaker box 110.

The pre-force of the elastic component 130 and the air pressure inside the speaker box 110 equal to the air pressure outside the speaker box 110, and thus the first vibrating assembly 122 maintains at the equilibrium position. The speaker unit 120 maintains at a constant equilibrium position by adjusting the air pressure inside/outside the speaker box 110 and the pre-force of the elastic component 130, that is, the first vibrating assembly 122 vibrates with a constant equilibrium position as a basis. Consequently, the pre-force produced from the elastic component 130 in the speaker box 110 compensates for the decreased air pressure in the speaker box 110, and thus the elastic coefficient of the speaker box 110 (which are provided by the air and the elastic component 130 in the speaker box 110) is not increased due to the decreased air volume in the speaker box 110. The total elastic coefficient of the speaker box 110 is decreased due to the elastic component 130, and which results a good response to the low-frequency with the resonant frequency of the speaker structure 100. As a result, the good acoustical quality is kept while the volume of the speaker structure 100 is decreased.

Figure 2:
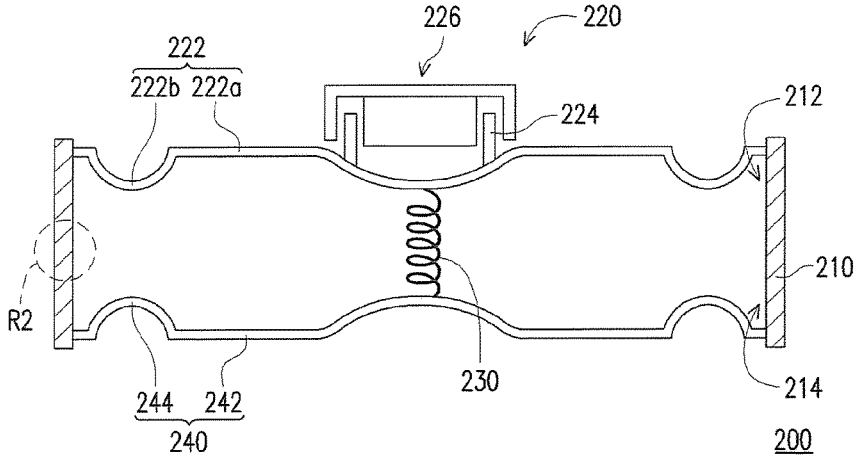
FIG. 2 is a schematic diagram showing a speaker structure in an embodiment.

FIG. 2 is a schematic diagram showing a speaker structure in an embodiment. In the embodiment, the speaker structure 200 includes a speaker box 210, a speaker unit 220, and an elastic component 230. The speaker unit 220 is disposed on the speaker box 210, and the speaker unit 220 includes a first vibrating assembly 222. The elastic component 230 is disposed in the speaker box 210 and connected to the first vibrating assembly 222 of the speaker unit 220 and the speaker box 210. The air pressure inside the speaker box 210 is lower than the air pressure outside the speaker box 210. Consequently, when the speaker unit 220 operates, the first vibrating assembly 222 of the speaker unit 220 vibrates the air inside the speaker box 210 and the elastic component 230 produces a corresponding pre-force.

The configuration and function of the speaker structure 200 is similar to that of the speaker structure 100, in the embodiment, the speaker structure 200 further includes a second vibrating assembly 240. The structures of the speaker box 210, the speaker unit 220 (including the first vibrating assembly 222, the first vibrating diaphragm 222*a*, the first suspension side edge 222*b*, the voice coil 224, and the magnetic loop assembly 226) and the elastic component 230 can refer to the speaker box 110, the speaker unit 120 (including the first vibrating assembly 122, the first vibrating diaphragm 122*a*, the first suspension side edge 122*b*, the voice coil 124, and the magnetic loop assembly 126) and the elastic component 130 in FIG. 1, which are omitted herein for a concise purpose.

In an embodiment, the speaker box 210 is ring-shaped and includes opposite openings 212 and 214. The first vibrating assembly 222 and the second vibrating assembly 240 are disposed at the speaker box 210 and covers the opening 212, 214, respectively, and the speaker box 210 is sealed. The first vibrating assembly 222 and the second vibrating assembly 240 are connected to the elastic component 230.

In the above embodiment, the first vibrating assembly 222 and the second vibrating assembly 240 are disposed at two opposite sides of the speaker box 210, two ends of the elastic component 230 in the speaker box 210 is connected to the first vibrating assembly 222 and the second vibrating assembly 240, respectively. As a result, when the speaker unit 220 operates, the first vibrating assembly 222 vibrates to push the elastic component 230, and then the elastic component 230 drives the second vibrating assembly 240 to vibrate. The first vibrating assembly 222, the elastic component 230, and the second vibrating assembly 240 have linkage with each other.

In an embodiment, the second vibrating assembly 240 includes a second vibrating diaphragm 242 and a second suspension side edge 244. The second vibrating diaphragm 242 is disposed at the speaker box 210 and connected to the elastic component 230. The second suspension side edge 244 is disposed at the speaker box 210 and connected to the second vibrating diaphragm 242. In other words, the elastic component 230 is connected to the second vibrating diaphragm 242, and the second suspension side edge 244 is connected to the second vibrating diaphragm 242 and surrounds outer edge of the second vibrating diaphragm 242.

In an embodiment, the second vibrating diaphragm 242 is circle shaped, the suspension side edge 244 is ring-shaped (the section of the ring-shaped suspension side edge 244 shown in FIG. 2 locates at two sides of the second vibrating diaphragm 242, respectively), which is not limited herein.

In an embodiment, the second vibrating diaphragm 242 and the second suspension side edge 244 includes a concave surface, respectively, the concave surface is towards the speaker box 210, and thus the thickness of the speaker structure 200 is not increased. However, the shape of the second vibrating diaphragm 242 and the shape of the second suspension side edge 244 are adjustable and not limited herein.

The structure of the second vibrating assembly 240 and that of the first vibrating assembly 222 are similar, and the difference is that the second vibrating assembly 240 is not connected to the voice coil 224 and the magnetic loop assembly 226 of the speaker unit 220. In other words, the second vibrating assembly 240 is a vibrating component corresponding to the first vibrating assembly 222 of the speaker unit 220. When the speaker unit 220 operates, the magnetic loop assembly 226 drives the voice coil 224 to vibrate, and the voice coil 224 drives the first vibrating assembly 220 to vibrate. The first vibrating assembly 222 vibrates and drives the elastic component 230, and then the elastic component 230 pushes the second vibrating diaphragm 242 to vibrate, while the second suspension side edge 244 is regarded as the suspension structure, and push the air in the speaker box 210. The elastic component 230 produces the pre-force in the above process, and the total of the pre-force and the air pressure inside the speaker box 110 equals to the air pressure outside the speaker box 110, and thus the first vibrating assembly 222 maintains at the equilibrium position.

The first vibrating assembly 222 and the second vibrating assembly 240 of the speaker unit 220 maintain at a constant equilibrium position by adjusting the air pressure difference inside and outside the speaker box 210 and adjusting the pre-force of the elastic component 230. The pre-force of the elastic component 230 compensate for the decreased air pressure in the speaker box 210, and thus the elastic coefficient (provided by the air of the speaker box 210 and the elastic component 230) of the speaker box 210 is not increased when the volume is decreased and the air is reduced. Consequently, the elastic coefficient of the speaker box 210 is decreased with the configuration of the elastic component 230, and thus the low-frequency response with the resonant frequency of the speaker structure 200 is good. As a result, the speaker structure 200 is decreased while good acoustical quality is obtained.

Figure 3:
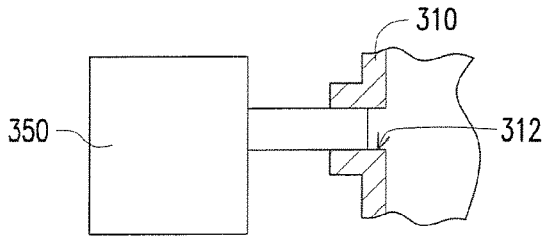
FIGS. 3 to 5 are schematic diagrams showing partial of the speaker structure in embodiments.
Figure 4:
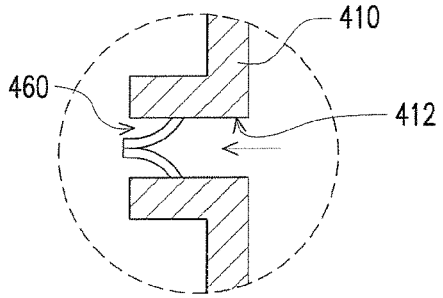
Figure 5:
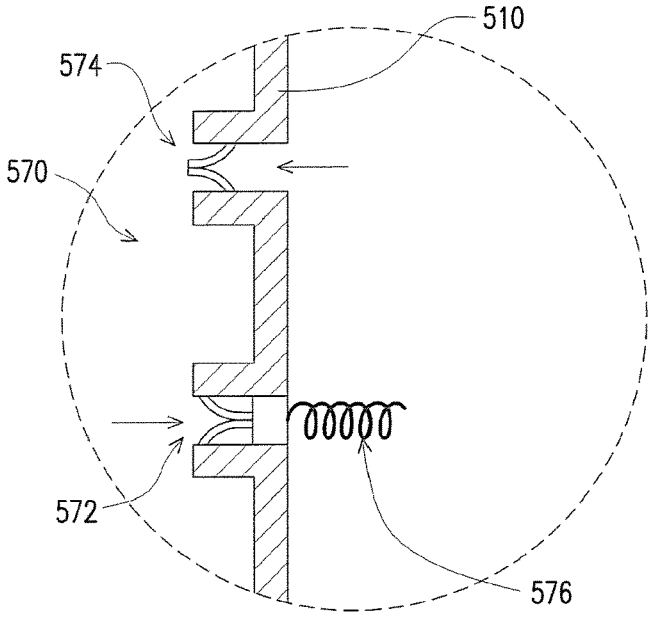

FIG. 3 to FIG. 5 are schematic diagrams showing partial of the speaker structure in embodiments. As shown in FIG. 3, the speaker structure further includes a gas extraction device 350 configured at the speaker box 310 and connected to the speaker box 310 to extract the air inside the speaker box 310 outside the speaker box 310. The difference among the speaker structure in the embodiment and the speaker structure 100 and 200 in the above embodiments is the gas extraction device 350 is further configured, the speaker box 310 is similar to the speaker box 110 and 210, and the gas extraction device 350 is applicable to the speaker box 110 and 210 (for example, the gas extraction device 350 is disposed at the region R1 and R2). Please refer to the illustration of the speaker box 110 and 210, the detailed structure of the speaker box 310 is omitted herein for a concise purpose.

In an embodiment, the air inside the speaker box 310 of the speaker structure is extracted out according to practical requirements in the assembly to make the air pressure inside the speaker box 310 lower than that outside the speaker box 310. However, in an embodiment, the air outside the speaker box 310 gets in the speaker box 310 from the gap among the components of the speaker structure or from the gap in the components (in an embodiment, the first vibrating assembly includes small holes) to enter in the speaker box 310, and then the air pressure inside the speaker box 310 exceeds a predetermined value.

In the embodiment, the gas extraction device 350 is disposed at the speaker box 310. In an embodiment, the gas extraction device 350 is disposed at the opening 312 of the speaker box 310, the gas extraction device 350 connects though the speaker box 310 via the opening 312. When the air pressure inside the speaker box 310 exceeds a predetermined value, the excessive air inside the speaker box 310 is extracted outside the speaker box 310 via the gas extraction device 350 to maintain the air pressure inside the speaker box 310 at a popper range. As a result, the air pressure inside the speaker box 310 is maintained.

In FIG. 4, the speaker structure further includes a check valve 460 disposed at the speaker box 410, the check valve 460 communicates with the speaker box 410 to make the air inside the speaker box 410 get out of the speaker box 410 and block the air outside the speaker box 410 to enter into the speaker box 410. The difference among the speaker structure in the embodiment and that of the speaker structure 100 and 200 is the check valve 460 is further configured. The check valve 460 is applicable to the speaker box 110 and 210 (for example, the check valve 460 is disposed at the region R1 in FIG. 1 or the region R2 in FIG. 2). Please refer to the illustration of the speaker box 110 and 210, the detailed structure of the speaker box 410 is omitted herein for a concise purpose.

In an embodiment, the air inside the speaker box 410 of the speaker structure is extracted out according to practical requirements in the assembly to make the air pressure inside the speaker box 310 lower than that outside the speaker box 31. However, in an embodiment, the air outside the speaker box 310 gets in the speaker box 410 after long-used, and then the air pressure inside the speaker box 410 exceeds a predetermined value.

In the embodiment, the check valve 460 is disposed at the speaker box 410. In an embodiment, the check valve 460 is disposed at the opening 412 of the speaker box 410 to communicate with the speaker box 410 and limit the airflow. The excessive air inside the speaker box 410 flows out the speaker box 410 via the check valve 460 to make the air pressure in the speaker box 410 meet the requirement, and the air outside the speaker box 410 is blocked by the check valve 460 from entering into the speaker box 410 through the opening 412. Consequently, the air pressure in the speaker box 410 is maintained.

As shown in FIG. 5, in the embodiment, the speaker structure further includes a barometric correction system 570 disposed at the speaker box 510 and communicate with the speaker box 510. The barometric correction system 570 includes a first check valve 572, a second check valve 574, and an elastic member 576. The first check valve 572 and the second check valve 574 are disposed at the speaker box 510 and communicate with the speaker box 510, respectively.

The elastic member 576 is connected to the first check valve 572, and the elastic member 576 is disposed in the speaker box 510. The speaker structure in this embodiment is further configured with the barometric correction system 570 then that in the speaker structure 100 and 200. The speaker box 510 is similar to the speaker box 110 and 210. The barometric correction system 570 is also applicable to the speaker box 110 and 210 (for example, the barometric correction system 570 is disposed at the region R1 in FIG. 1 or the region R2 in FIG. 2). Please refer to the illustration of the speaker box 110 and 210 for the detailed structure of the speaker box 510 which is omitted herein for a concise purpose.

In the embodiment, the air inside the speaker box 510 of the speaker structure is extracted out according to practical requirements in the assembly to make the air pressure in the speaker box 510 lower than outside the speaker box 510. However, in an embodiment, the air outside the speaker box 510 flows in or out of the speaker box 510 after frequently-used, and then the air pressure in the speaker box 410 is changed. In the embodiment, a barometric correction system 570 is disposed at the speaker box 510. The first check valve 572 and the second check valve 574 are disposed at the speaker box 510. In an embodiment, the first cheek valve 572 and the second check valve 574 are configured at the opening 512 and 514 of the speaker box 510, respectively, and the first check valve 572 and the second check valve 574 communicate with the speaker box 510 via the opening 512 and 514, respectively.

The first check valve 572 and the second check valve 574 limits the airflow in one way, and the directions that air flows through the first check valve 572 and that flows through the second check valve 574 are opposite. In addition, the elastic member 576 is connected to the first check valve 572 to against the open of the first check valve 572.

When the air pressure inside the speaker box 510 meets the requirements, the air inside the speaker box 510 is enough to support the elastic member 576 against the first check valve 572, and the first check valve 572 keeps in the close state to prevent the air flow out of the speaker box 510 from entering in the speaker box 510 through the first check valve 572. The second check valve 574 prevents the air outside the speaker box 510 from entering in the speaker box 510.

When the air pressure inside the speaker box 510 is lower than a predetermined value, that is, the air inside the speaker box 510 does not meets the requirement, therefore, the air outside the speaker box 510 pushes the elastic member 576 and enters into the speaker box 510 through the first check valve 572 until the air pressure in the speaker box 510 reaches the predetermined value. Then, the air inside the speaker box 510 is enough to support the elastic member 576 to against the open of the first check valve 572, and the air outside the speaker box 510 stops to enter the speaker box 510.

When the air pressure inside the speaker box 510 is higher than the predetermined value, which means the air inside the speaker box 510 does not meet the requirement, and the excessive air inside the speaker box 510 flows out of the speaker box 510 from the second check valve 574 to balance the air pressure inside the speaker box 510 to meet the requirement. In the embodiment, the air pressure inside the speaker box 510 is easily maintained.

In sum, in embodiments described above, the elastic component in the speaker box is connected to the first vibrating assembly and the speaker box of the speaker unit, and the air pressure inside the speaker box is kept lower than the air pressure outside the speaker box. When the speaker unit operates, the first vibrating assembly vibrates to push the air in the speaker box and drive the elastic component to generate a pre-force correspondingly, and the pre-force of the elastic component and the air pressure inside the speaker box equal to the air pressure outside the speaker box, and then the first vibrating assembly maintains at the equilibrium position.

The air pressure inside the speaker box is reduced accordingly, and the volume of the speaker box is thus reduced. The speaker unit drivers the elastic component to vibrate, which compensates for the pre-force of the reduced air in the speaker box to balance the vibration of the first vibrating assembly. Consequently, the acoustical quality is kept while the volume of the speaker structure is decreased.

Although the invention has been disclosed with reference to certain preferred embodiments thereof, the disclosure is not for limiting the scope. Persons having ordinary skill in the art may make various modifications and changes without departing from the spirit and the scope of the invention. Therefore, the scope of the appended claims should not be limited to the description of the preferred embodiments described above.

What is claimed is:

1. A speaker structure, comprising:

a speaker box, wherein an air pressure inside the speaker box is lower than the air pressure outside the speaker box;

a speaker unit disposed on the speaker box and including a first vibrating assembly;

an elastic component disposed in the speaker box and directly connected to the first vibrating assembly and the speaker box, wherein when the speaker unit operates, the first vibrating assembly of the speaker unit vibrates, and the elastic component produces a pre-force correspondingly, the total pressure of the pre-force and the air pressure inside the speaker box equals to the air pressure outside the speaker box, thus to maintain the first vibrating assembly at an equilibrium position; and a second vibrating assembly disposed on the speaker box and connected to the elastic component, wherein when the speaker unit operates, the first vibrating assembly vibrates and pushes the elastic component, and the elastic component pushes the second vibrating assembly to vibrate.

2. The speaker structure according to claim 1, wherein the first vibrating assembly includes a first vibrating diaphragm and a first suspension side edge, the first vibrating diaphragm is disposed on the speaker box and connected to the elastic component, the first suspension side edge is disposed on the speaker box and connected to the first vibrating diaphragm, when the speaker unit operates, the first vibrating diaphragm vibrates with the first suspension side edge.

3. The speaker structure according to claim 1, wherein the second vibrating assembly includes a second vibrating diaphragm and a second suspension side edge, the second vibrating diaphragm is disposed on the speaker box and connected to the elastic component, the second suspension side edge is disposed on the speaker box and connected to the second vibrating diaphragm, when the speaker unit operates, the first vibrating assembly vibrates to push the elastic component, the elastic component pushes the second vibrating diaphragm to vibrate with the second suspension side edge regarded as a suspension structure.

4. The speaker structure according to claim 1, wherein the air pressure inside the speaker box is less than 80% of the air pressure outside the speaker box.

5. The speaker structure according to claim 1, wherein the inside of the speaker box is vacuumed.

6. The speaker structure according to claim 1, wherein a material of the elastic component includes a nonmagnetic material.

7. The speaker structure according to claim 1, further comprising:

a check valve disposed at the speaker box and communicating with the speaker box.

8. The speaker structure according to claim 1, further comprising:

a gas extraction device disposed at the speaker box and communicating with the speaker box.

9. The speaker structure according to claim 1, further comprising:

a barometric correction system including a first check valve, a second check valve, and an elastic member, wherein the first check valve and the second check valve are disposed at the speaker box and communicate with the speaker box, respectively, the elastic member is connected to the first check valve and disposed in the speaker box, an air outside the speaker box pushes the elastic member and enters into the speaker box through the first check valve, when the air pressure inside the speaker box is higher than a predetermined value, the air inside the speaker box flows out of the speaker box through the second check valve.

* * * * *